US006793039B2

(12) United States Patent
Schmid, Jr.

(10) Patent No.: US 6,793,039 B2
(45) Date of Patent: Sep. 21, 2004

(54) SUBMERGED WATER ACTIVITY PLATFORM

(76) Inventor: Jerome R. Schmid, Jr., 2555 Scenic Cir., Seneca, SC (US) 29672

( * ) Notice: Subject to any disclaimer, the term of this patent is extended or adjusted under 35 U.S.C. 154(b) by 107 days.

(21) Appl. No.: 10/097,661

(22) Filed: Mar. 13, 2002

(65) Prior Publication Data

US 2003/0173152 A1 Sep. 18, 2003

(51) Int. Cl.[7] ..... E04G 3/00; E04G 1/18

(52) U.S. Cl. ..... 182/84; 182/141; 14/69.5; 405/221

(58) Field of Search ..... 114/362; 14/69.3, 14/71.1, 71.3; 182/84, 83, 127, 82, 85, 87, 86, 141, 97, 150, 95, 91; 108/143, 147, 144.11; 248/188.2, 188.4; 280/163–166; 405/1, 3, 4, 218–219, 221

(56) References Cited

U.S. PATENT DOCUMENTS

| | | | | | |
|---|---|---|---|---|---|
| 3,528,574 | A | * | 9/1970 | Denner et al. | 182/127 |
| 3,559,762 | A | | 2/1971 | Thompson | 182/93 |
| 3,592,468 | A | | 7/1971 | Simendinger, Jr. | 273/1 |
| 3,731,761 | A | | 5/1973 | Glenn | 182/1 |
| 3,813,703 | A | | 6/1974 | Beaudin, Jr. | 4/172 |
| 3,841,439 | A | * | 10/1974 | Nilsson et al. | 182/86 |
| 3,949,693 | A | | 4/1976 | Bauer et al. | 114/0.5 D |
| 4,079,815 | A | | 3/1978 | Cormier | 182/195 |
| 4,107,932 | A | | 8/1978 | Cantrell | 61/48 |
| 4,271,542 | A | | 6/1981 | Wood et al. | 4/495 |
| 4,590,634 | A | * | 5/1986 | Williams | 14/71.1 |
| 4,823,910 | A | * | 4/1989 | Day | 182/84 |
| 4,907,674 | A | | 3/1990 | Miller | 182/150 |
| 4,910,814 | A | | 3/1990 | Weiner | 4/488 |
| 5,025,747 | A | | 6/1991 | Grayson | 114/362 |
| 5,044,465 | A | | 9/1991 | Rinke | 182/97 |
| 5,056,167 | A | | 10/1991 | Cholley | 4/492 |
| 5,106,237 | A | * | 4/1992 | Meldrum | 405/221 |
| 5,247,899 | A | * | 9/1993 | Boesser | 114/263 |
| 5,507,596 | A | | 4/1996 | Bostelman et al. | 405/191 |
| 5,626,440 | A | | 5/1997 | Greene, Jr. et al. | 405/218 |
| 5,794,292 | A | * | 8/1998 | Ricci, Jr. | 14/69.5 |
| 5,829,380 | A | * | 11/1998 | Smith | 114/362 |
| 6,119,809 | A | * | 9/2000 | McClendon, Jr. | 182/84 |
| 6,237,523 | B1 | | 5/2001 | Day et al. | 114/362 |
| 6,401,861 | B1 | * | 6/2002 | Marszalek | 182/84 |

* cited by examiner

*Primary Examiner*—Hugh B. Thompson, II
(74) *Attorney, Agent, or Firm*—McNair Law Firm, P.A.

(57) ABSTRACT

A submergible activity platform for attachment to an associated structure on a body of water is disclosed. The activity platform for supporting persons engaged in water activities includes a platform area extending outwardly from and alongside the associated structure. A support structure is carried by the activity platform for mounting the activity platform to the associated structure so that the activity platform is located at a desired depth in the water when mounted to the associated structure. A walkway is included in for providing access between the associated structure and the activity platform when submerged. The activity platform includes a water activity section free of the walkway where water activities may take place. The activity platform also includes a plurality of water flow passages for allowing water to flow through the activity platform when submerged to reduce the force of water currents against the activity platform.

19 Claims, 5 Drawing Sheets

SUBMERGED WATER ACTIVITY PLATFORM

FIELD OF THE INVENTION

The present invention relates to a submergible water activity platform for attachment to an associated structure to provide a platform for getting into the water from the associated structure and getting out of the water onto the associated structure. More particularly, the present invention relates to an adjustable submerged activity platform that can be moved to a desired position to accommodate a desired water depth or changes in water level.

BACKGROUND OF THE INVENTION

Swimming facilities, whether in pools, rivers, ponds, lakes, and oceans, often provide ladders for people to enter and exit deep water. These ladders may be attached to the end of docks, piers, or even free-floating platforms anchored in the middle of a lake. These ladders are usually slippery and require a person to exert substantial strength to pull their body out of the water and onto the ladder. Persons who have trouble using ladders, including the handicapped, elderly, and even small children are effectively banned from participating in recreational water activities associated with deep-water facilities. The ladder also fails to provide any underwater support that extends safely away from the dock or pier on which a person can rest or even participate in deep water recreational activities. People, as well as animals, specifically certain breeds of dogs, enjoy jumping and swimming from docks and other water facility structures, but often are in danger of drowning when they cannot climb back on the dock or find a place to rest and are too tired to swim a long distance to shore. Therefore, a need exists for a device that can facilitate the entry and exit of persons and animals to and from an above water structure to the water and that provides underwater support for persons engaged in the recreational water activities in deep water onto which the person can swim without having to pull their body up out of the water.

As shown in the U.S. Pat. No. 3,559,762, a safety ladder is secured to a pylon of a dock, pier or other floating structure on a body of water that can be used for ingress and egress of a boat or the water to the dock. However, the ladder fails to provide any support that extends under the water away from the dock to provide a stable support platform for persons engaged in recreational water activities. Additionally, such a ladder is extremely difficult for handicapped or disabled persons to use in entering or exiting from deeper water.

U.S. Pat. No. 5,044,465 discloses a retractable walk-in swimming pool ladder designed specifically for use with swimming pools. As with the above-noted patent, the retractable ladder fails to provide any support means extending under the water for persons to engaged in recreational water activities and simply provides an access between the pool deck and the water. The individual must still pull his body up out of the water to walk up the steps of the ladder.

U.S. Pat. No. 3,813,703 discloses a swimming pool wading platform for use by small children. The platform is designed to allow children to enjoy water activities without the danger of entering deeper water over their heads that presents of drowning hazard. No access way is provided for entering the platform from an above water structure, and once on the platform you are limited to the platform area by a netting that would prevent persons from enter the platform from the water. Therefore, there is a need for a device that will permit easy and safe entry and egress for people and animals to participate in deep-water recreational activities in pools, rivers, lakes, ponds and oceans, while also providing a submerged support structure that allows people to swim directly onto the structure for support without having to pull their body up out of the water.

Accordingly, it is an object of the present invention to provide a water activity assembly that provides convenient access between an associated above water structure and a body of water to allow persons to move easily between the water and the above water structure.

It is an object of the present invention to provide a submerged activity platform extending safely away from the associated above water structure that allows persons to swim directly onto and off of the platform for support in the water while engaged in recreational water activities.

It is an object of the present invention to provide a submerged activity platform for simultaneously supporting multiple people engaged in recreational water activities.

SUMMARY OF THE INVENTION

The above objectives are accomplished according to the present invention by providing a submergible water activity assembly for use with an associated structure on a body of water to provide access from the associated structure to an activity platform for water activities. The assembly includes an activity platform for being submerged in the water to support persons engaged in water activities, which allows a person to swim directly onto or off of the activity platform without having to pull his body up out of the water. The activity platform includes a platform area that extends outwardly from and alongside the associated structure when attached to the associated structure. A support structure is carried by the activity platform for mounting the activity platform to the associated structure so that the activity platform is located at a desired depth in the water when mounted to the associated structure. A walkway is included in the assembly for providing access between the associated structure and the activity platform when the activity platform is submerged. The activity platform includes a water activity section free of the walkway in which water activities may take place. In the preferred embodiment, the activity platform also includes a plurality of water flow passages formed in the activity platform for allowing water to flow through the activity platform when submerged to reduce the force of water currents against the activity platform.

In a further advantageous embodiment, the activity platform includes a plurality of elongated decking members with water flow passages defined by narrow passages formed between adjacent decking members, which allow water to flow through the activity platform when submerged.

The activity platform preferably includes a landing section disposed at a base of the walkway adjacent to the water activity section for allowing a person to walk onto the activity platform from the walkway and enter the water activity section of the activity platform to engage in water recreation activities.

Advantageously, in the preferred embodiment, the support structure includes a first side frame carried on a first side of the activity platform, and a second side frame carried on a second side of the activity platform. The first and second side frames support the activity platform when mounted to the associated structure and submerged in the water.

In a further advantageous embodiment, the support structure of the activity platform includes an adjusting mechanism for vertically moving the activity platform to adjusting the depth of the activity platform in the water to accommodate a desired water depth for the platform or to accommodate changes in water levels on the body of water. Preferably, the adjusting mechanism includes a guide member affixed to the associated structure and a vertical frame leg carried by the activity platform. The guide member and the vertical frame leg are connected together for relative vertical movement so that the vertical position of the platform can be adjusted to a desired depth in the water. The guide member includes an adjusting element for setting the vertical frame leg at a desired position. In order to set the vertical frame leg at the desire position, the adjusting element is received by a complementary receiving element of the vertical frame leg, which holds the activity platform at a set position when submerged in the water.

In order to help secure the assembly to the associated structure, preferably, the support structure includes a retaining bracket, having a vertical leg for engaging a bottom edge portion of the associated structure to help prevent the activity platform from separating from the side of the associated structure. In the preferred embodiment, the support structure also includes a brace arm extending rearwardly along, and affixed to, the upper surface of the associated structure for resisting torque applied to the activity platform by the water or the weight of persons standing on the activity platform.

In a further advantageous embodiment, the walkway is defined by a floating ramp having a first end pivotally carried by the guide member at a fixed position, and a second end freely resting on the activity platform so that the walkway maintains contact with the activity platform as the platform is moved vertically to the desired depth in the water. A railing is carried by the ramp to help support people moving up and down the ramp to the activity platform.

Additionally, the preferred embodiment includes flotation members carried by the activity platform for providing buoyancy to offset the weight of the assembly in the water, as well as the weight of persons engaged in water activities on the platform. Accordingly, a submergible activity platform is provided that promotes ease of access to the water from the associated structure for water activities.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE PREFERRED EMBODIMENT

Figure 1:
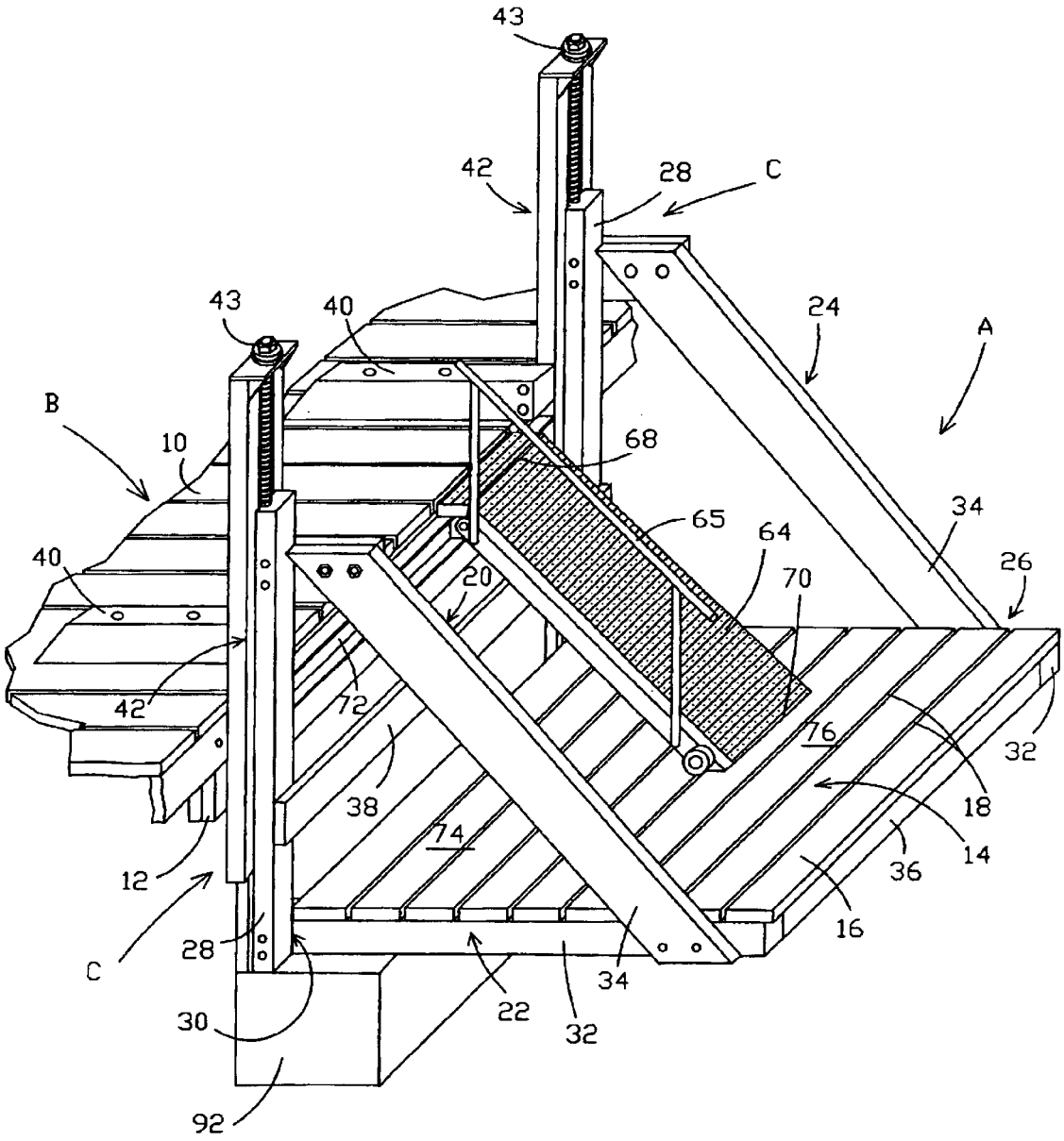
FIG. 1 shows perspective view of the adjustable embodiment of the activity platform according to the invention.

Referring now to the drawings, the invention will be described in more detail. FIG. 1 shows a preferred embodiment of a submergible water activity assembly, designated generally as A, carried by an associated structure, designated generally as B. Preferably, the water activity assembly is attached to both an upper surface 10 and a bottom edge portion 12 of the associated structure so that an activity platform, designated generally as 14, of the water activity assembly is carried submerged in the water. Activity platform 14 is submerged in the water to support persons engaging in water activities. The activity platform includes a platform area that extends outwardly from and alongside the associated structure when attached to the associated structure to provide a platform for getting into the water from the associated structure and getting out of the water on the associated structure. In the preferred embodiment, the platform area will support a minimum of six persons and range from 1.0 to 40.0 square meters with the platform submerged to a preferred depth range of between 0.25 to 1.5 meters. It is to be understood that these dimensions are for illustrative purposes of the preferred embodiment of the water activity assembly and not to be construed as limiting the assembly to the above-disclosed dimensions. Because the platform is submerged, people, as well as animals, can stand, sit, or swim off of or directly onto the submerged activity platform for support in the water, which effectively creates a shallow water area for people to enjoy water recreation activities around deep-water facilities. This provides a safe and convenient resting area to enjoy the deep-water activities without the worry of having to climb a slippery ladder attached to the end of a dock in order to get out of the water.

It is to be understood that the associated structure can be any above water structure such as a dock, pier, free-floating platform, deck surrounding a pool, or even a boat. According to the illustration of a preferred embodiment in FIG. 1, the associated structure is characterized by standard commercial dock, which extends from the shore of a body of water into deeper water for swimming and other recreational water activities.

In the preferred embodiment shown in FIG. 1, activity platform 14 is constructed from a plurality of elongated decking members 16 carried by a support structure that mounts the activity platform to the associated structure. Since the activity platform is submerged, the force of waves and currents in the water can damage the assembly. Therefore, the preferred embodiment includes a plurality of water flow passages formed into the activity platform for allowing water to flow through the activity platform with minimal resistance to reduce the force of water currents against the activity platform that could damage the platform by shifting it against the associated structure. As shown in FIG. 1, the water flow passages are defined by narrow passages 18 formed between adjacent decking members of the activity platform, which allows water to flow through the submerged activity platform. The water flow passages are not limited to spaces formed between decking members and could include openings forming into the decking members themselves or opening in any other type of platform such as a solid plastic platform incorporating openings for water to pass through.

As mentioned above, activity platform 14 is carried by a support structure, designated generally as C, which mounts the activity platform to the associated structure. The support structure spaces the submerged activity platform below a surface of the water and above a bottom of the body of water so that the activity platform is located at a desired depth in the water for supporting persons engaged in water activities. As shown in FIG. 1, the support structure includes a first side frame, designated generally as 20, carried on a first side 22 of activity platform 14. A second side frame, designated generally as 24, is carried on a second side 26 of activity platform 14. First side frame 20 and second side frame 24 support activity platform 14 when mounted to the associated structure and submerged in the water. First side frame 20 and second side frame 24 include an elongated vertical frame leg 28 for spacing the platform at a desired depth depending on the length of the vertical frame leg. Vertical frame leg 28 is connected to a horizontal frame leg 32 at a rearward location 30 of the activity platform. In the preferred embodiment of FIG. 1, horizontal frame leg 32 supports elongated decking members 16 that form activity platform 14. A diagonal frame leg 34 is connected between vertical frame leg 28 and horizontal frame leg 32 for supporting a front end 36 of the activity platform. To provide further rigidity between first side frame 20 and second side frame 24, a cross brace 38 is connected between vertical frame legs 28 of the first and second side frames. This helps prevent the platform from shifting side to side when water or persons apply lateral forces to the assembly. In order to mount the side frames to the associated structure, a brace arm 40, which connects to vertical frame legs 28, is provided that extends rearwardly from the side frames and the activity platform generally. Brace arm 40 is affixed to the upper surface of the associated structure to stabilize the activity platform when submerged in the water and, together with the side frames, transfers the weight of persons standing on the platform to the associated structure.

Figure 2A:
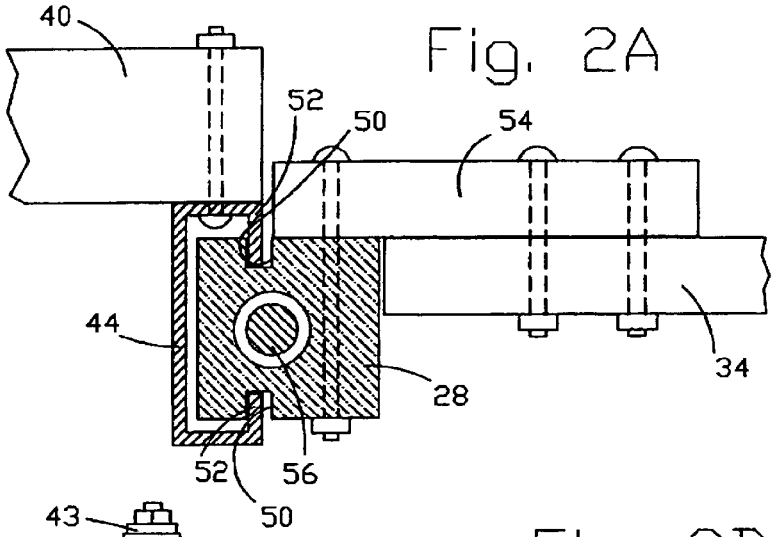
FIG. 2A shows an exploded top view of the adjusting mechanism according to the invention.
Figure 2B:
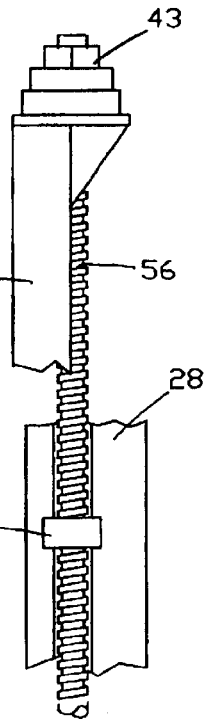
FIG. 2B shows a side cutaway view of the adjusting mechanism according to the invention.
Figure 2:
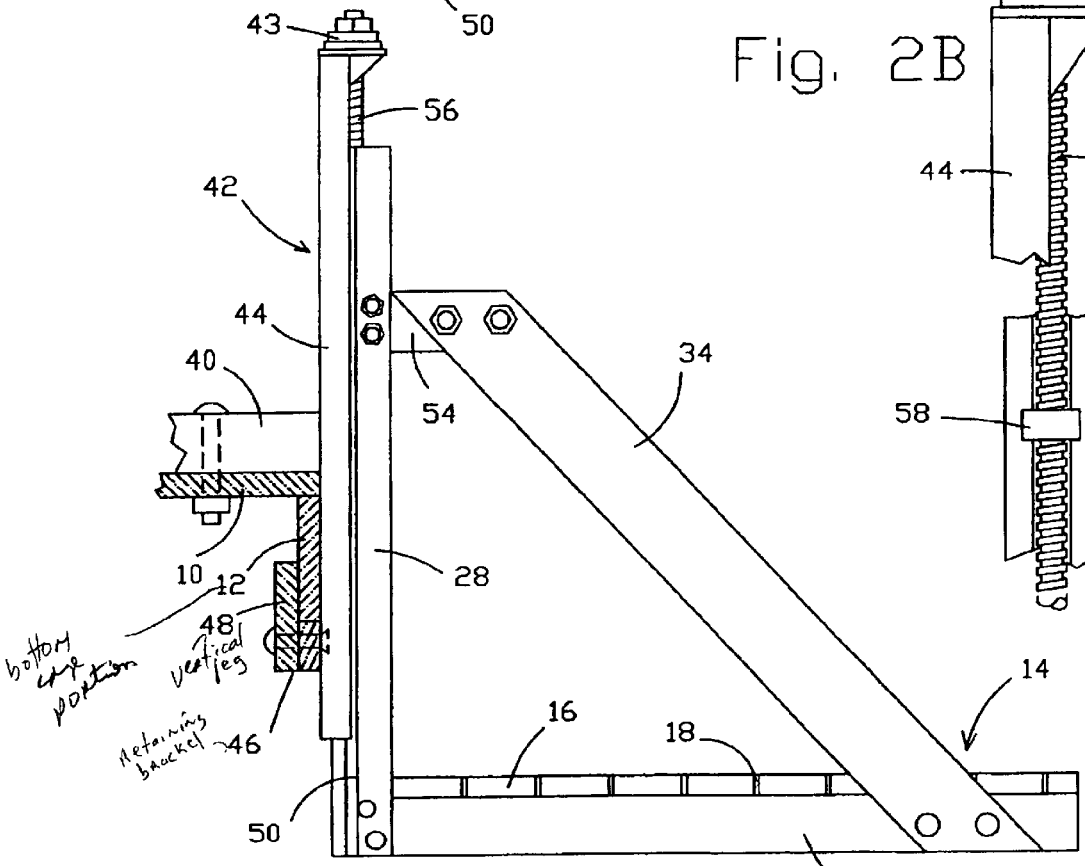
FIG. 2 show a side view of the adjustable activity platform according to the invention.

While brace arm 40 can be connected directly to the vertical frame legs to mount the activity platform to the associated structure, the preferred embodiment shown in FIG. 1 illustrates brace arm 40 being connected to an adjusting mechanism, designated generally as 42. Adjusting mechanism 42 is included in the support structure to allow for vertical movement of vertical frame legs 28 to adjust the depth of activity platform 14 in the water to change the desired depth or adjust to changes in water level. Referring now to FIG. 2, adjusting mechanism 42 includes a guide members 44 affixed to the associated structure by brace arm 40 and a retaining bracket 46 carried by a lower portion of guide members 44. Retaining bracket 46 affixes the lower portion of guide member 44 to the bottom edge portion of the associated structure. The retaining bracket includes a vertical leg 48 for applying pressure to bottom edge portion 12 of the associated structure, which helps to limit the ability of the activity platform to move away from the associated structure when persons are engaged in water activities. Guide member 44 and vertical frame leg 28 are connected together for relative vertical movement so that the vertical position of the platform can be adjusted to a desired depth in the water. As best shown in FIG. 2A, vertical frame leg 28 includes channel 50 for receiving a lip portion 52 of guide member 44, which prevents vertical leg 28 from pulling away from guide member 44. As is also shown in FIG. 2A, diagonal frame leg 34 can is connected to vertical frame leg 28 by a connecting frame leg 54. While diagonal frame leg 34 can be connected directly to vertical frame leg 28, connecting frame leg 54 allows for the diagonal frame leg to be spaced further toward front portion 36 of the activity platform to provide greater support when the length of the activity platform is increased.

Guide member 44 includes an adjusting element 56 for setting the vertical frame leg to a desired depth. As best shown in FIG. 2B, adjusting element 56 is received by a complementary receiving element carried by vertical frame leg 28 to hold the submerged activity platform at a set position in the water. Preferably, adjusting element 56 and complementary receiving element 58 comprise a worm gear system where adjusting element 56 is a threaded rod and complementary receiving element 58 is a nut for receiving the threaded rod. Rotation of a top nut 43, located atop guide member 44, turns the threaded rod to force the nut carried by the vertical frame leg to move the vertical frame leg vertically along guide member 44.

Figure 3A:
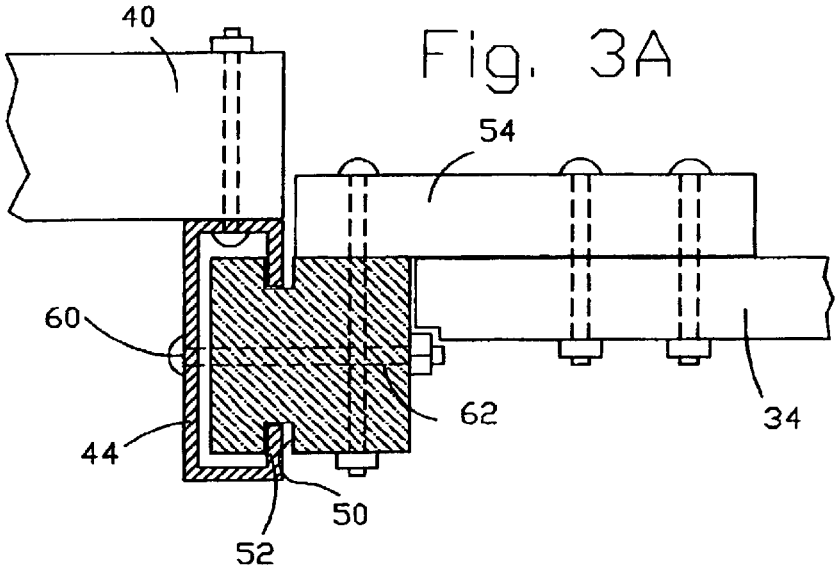
FIG. 3A shows an exploded top view of the alternative adjusting mechanism of FIG. 3.
Figure 3:
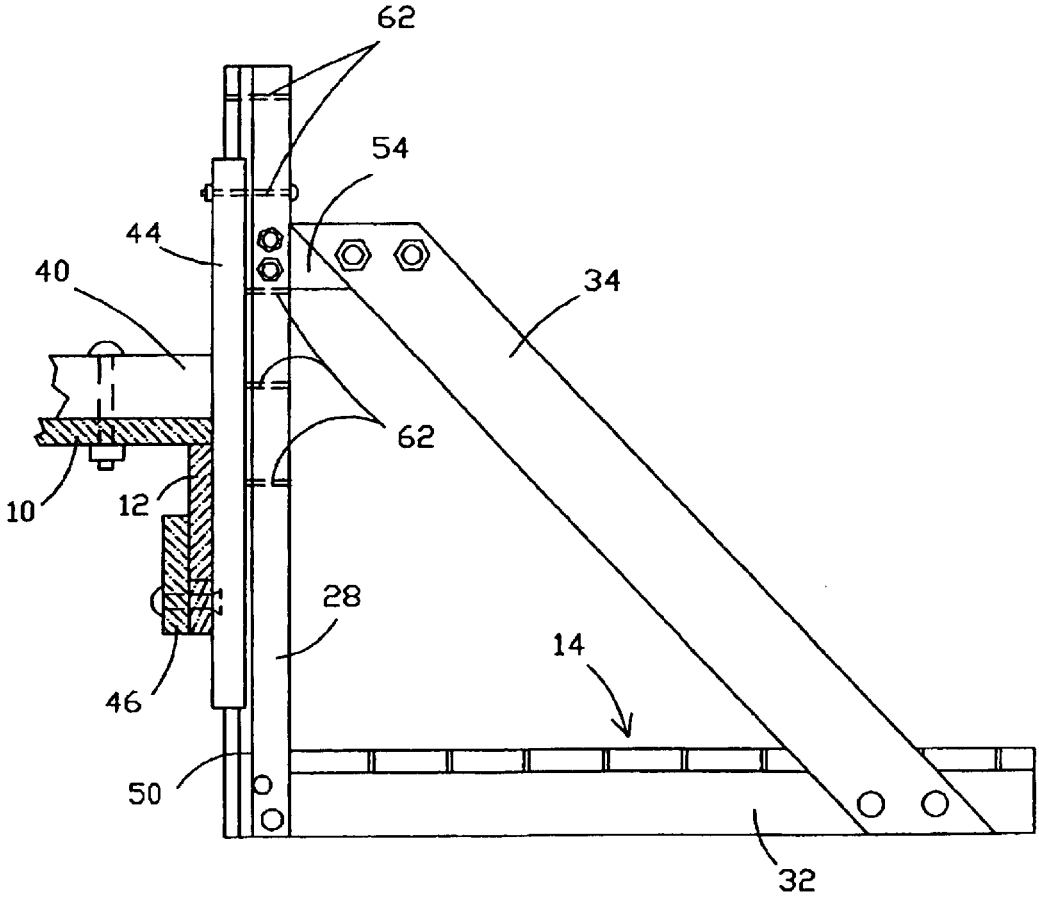
FIG. 3 shows a side view of an alternative embodiment of the adjusting mechanism according to the invention.

In an alternative embodiment of the adjusting mechanism illustrated in FIGS. 3 and 3A, the adjusting element comprises a retaining bolt 60 (FIG. 3A) that passes through an opening in guide member 44 and is received by the complementary receiving element, which comprises a plurality of incrementally spaced slots 62 in vertical frame leg 28. The depth of the activity platform is adjusted by selecting the desired incremental slot, aligning the slot with the opening in guide member 44 by raising or lowering the activity platform, and inserting retaining bolt 60 through the opening in the guide member and into the desired slot.

Figure 4:
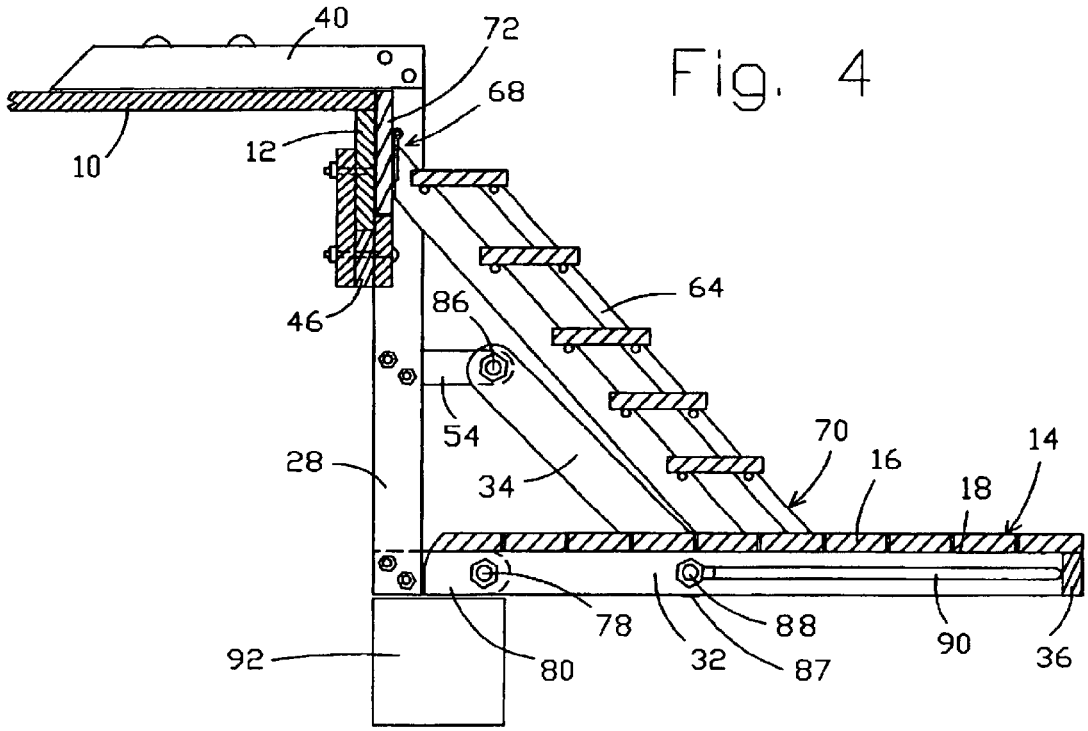
FIG. 4 shows a cross section view of the retractable activity platform embodiment in the extended position according to the invention.

Referring now to FIG. 1, in the preferred embodiment, a walkway 64 is included in the assembly that extends from the associated structure to the submerged activity platform to provide access between the associated structure and the activity platform. In an embodiment without adjusting mechanism 42, walkway 64 may be carried by support structure C and activity platform 14, but may also be connected directly to the associated structure as a more permanent addition. In the preferred embodiment, walkway 64 is a floating ramp having a first end 68 pivotally carried by guide member 44 and a second end 70 freely resting on submerged activity platform 14, so that the walkway maintains contact with the submerged activity platform as the platform is moved vertically by the adjusting mechanism to a desired depth in the water. First end 68 is carried on guide member 44 at a fixed location level with the upper surface of the associated structure to allow people to step directly onto the ramp and walk down to the submerged activity platform. As shown in FIG. 1, walkway 64 is carried between guide members by a connecting member 72, which allows the ramp to pivot up and down with vertical movement of the activity platform and remain fixed at first end 68 to the level of the upper surface of the associated structure. Walkway 64 could alternatively be comprised from a set of stairs disposed between the upper surface of the associated structure and the activity platform, as shown in FIG. 4. In a further advantageous embodiment, a railing 65 is carried by the walkway (FIG. 1) to help support persons moving between the associated structure and the submerged activity platform.

In order to provide a suitable platform for holding several people to perform water activities, the submerged activity platform includes a water activity section 74 free of the walkway in which the water activities may take place. The water activity section provides a stable underwater platform for persons to enjoy water recreation activities without having to enter the deeper water surrounding the platform, or allows persons to easily enter the surrounding deeper water without having to jump from the associated structure. To provide convenient access from walkway 64 to water activity section 74 of platform 14, a landing section 76 is disposed at a base of the walkway on the activity platform adjacent to the water activity section for allowing a person to walk onto said submerged activity platform from the walkway and enter the water activity section of the platform without stepping off the submerged activity platform. This allows people to walk directly down the ramp or stairs onto the submerged activity platform without having to step directly from the walkway to the large water activity section of the platform and risk falling.

Figure 4A:
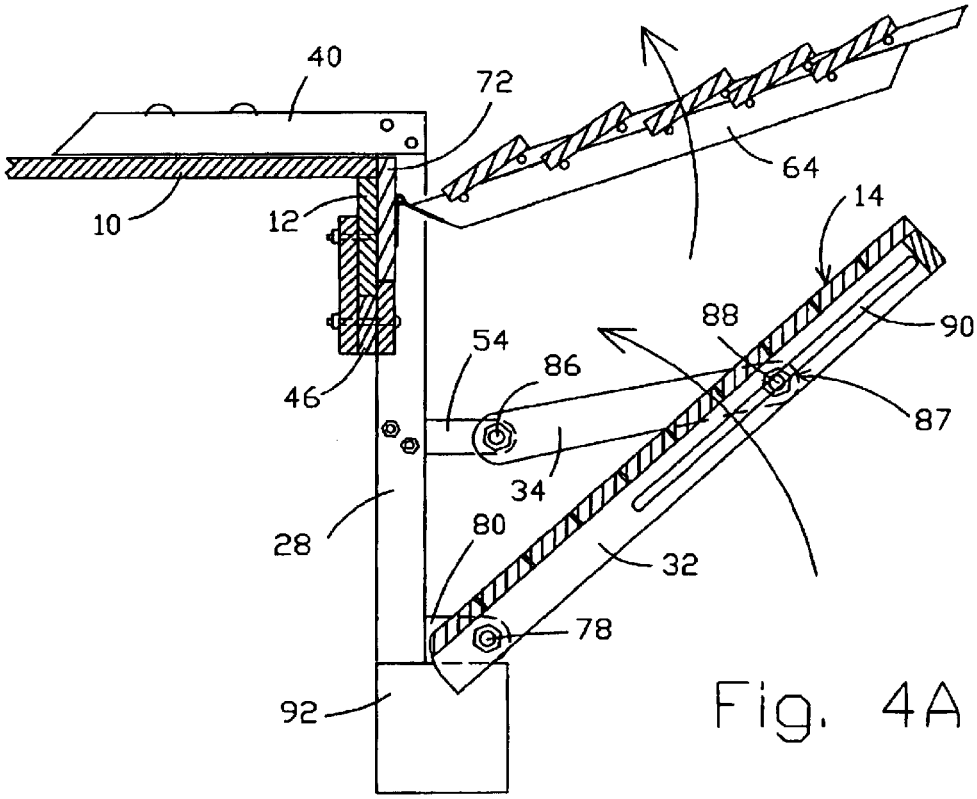
FIG. 4A shows a cross section view of the retractable activity platform embodiment being moved to the retracted position according to the invention; and, FIG. 4B shows a top view of the retractable activity platform embodiment according to the invention.
Figure 4B:
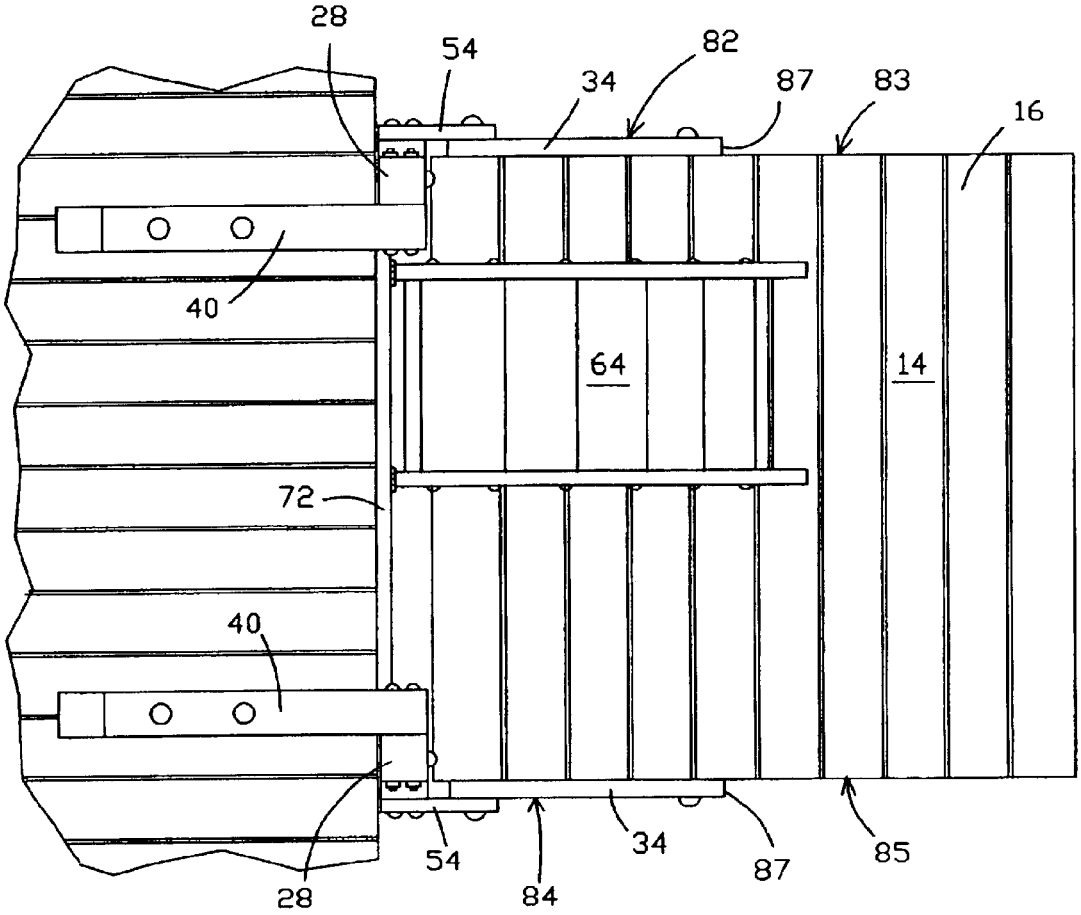

Referring now to FIG. 4, an alternative embodiment of the assembly is shown having the ability to retract the submerged activity platform to limit attractive nuisance problems, as well as to minimize the formation of algae or barnacles on the assembly. FIG. 4 illustrates a cross section view of the retractable embodiment of the water activity assembly. In the preferred embodiment, the retractable water activity assembly includes a retractable activity platform, designated generally as 14, for supporting persons engaged in water activities. Retractable activity platform 14 includes horizontal frame legs 32 having a pivot connection 78 for pivotally connecting the platform to a lower connecting leg 80, which is carried by vertical frame leg 28. Alternatively, retractable activity platform 14 may be pivotally connected directly to vertical frame leg 28 but the support structure prevents the platform from rotating to a vertical position without substantial modification to the support structure or the retractable activity platform. The retractable activity platform has an extended position when submerged in the water wherein the submerged activity platform extends outwardly from and alongside the associated structure, as best shown in FIG. 4B. The activity platform also has a retracted position wherein the platform is retracted inward towards the associated structure so that the platform may be stowed, as best shown in FIG. 4A. The platform can be raised and lower by such simple means as a rope affixed to front portion 36 of the platform, or by more elaborate mechanical means known by those skilled in the art of retractable platforms.

In order to retract the submerged activity platform, the support structure carrying the platform must also be movable. As shown in FIG. 4B, the support structure includes a first movable side frame 82 carried on a first side 83 of the platform, and a second movable side frame 84 carried on a second side 85 of the platform. The first and second movable side frames being movable to a first configuration when the platform is in the retracted position as shown in FIG. 4A, and movable to a second configuration when the platform is supported in the extended position submerged in the water, as shown in FIG. 4.

The first and second movable side frames include vertical frame leg 28 affixed to the associated structure by brace arm 40 and retaining bracket 46. Connecting leg 80 pivotally connects horizontal frame leg 32 to vertical frame leg 28. Diagonal frame leg 34 is pivotally connected at a first end 86 to connecting leg 54 carried by vertical frame leg 28 and slidably connected at a second end 87 to horizontal frame leg 32 by connector 88 for supporting the platform in the extended position. Preferably, connector 88 is a peg extending from second end 87 of the diagonal frame leg. Horizontal frame leg 32 includes a slot 90 for receiving connector 88 to allow diagonal frame leg 34 to slide along slot 90 of the horizontal frame leg and move said platform between the retracted and extended positions. However, before the platform can be retracted, the walkway must first be moved to a withdrawn position. As shown in a preferred embodiment of FIG. 4, walkway 64 is a set of collapsible steps having a first end 68 pivotally carried by connecting member 72, which is disposed between vertical frame legs 28. The steps are shown in a deployed position with second end 70 resting on the retractable activity platform in the extended position. As shown in FIG. 4A, the steps are rotated upward to allow the retractable activity platform to move to the retracted position as described above.

It is understood that the water activity assembly can be made from a variety of materials, for example, treated and non-treated wood, iron, steel, aluminum, and titanium, but is not limited to these materials. Buoyancy is critical for metal and high-density composite construction materials, and convenient for wood, which is naturally buoyant. As shown in FIG. 4, a flotation member 92 is carried underneath the retractable activity platform to provide buoyancy to offset the weight of the assembly in the water and persons standing on the platform in order to reduce the torque load applied to the associated structure. In the preferred embodiment, the flotation member or members are capable of providing neutral to plus 25% of weight buoyancy to the assembly in fresh or salt water. Because buoyancy also exerts a force on the associated structure, it is important to install the majority of the flotation members underneath the activity platform next to the associated structure so that the flotation does not place undue torque on the support structure.

While a preferred embodiment of the invention has been described using specific terms, such description is for illustrative purposes only, and it is to be understood that changes and variations may be made without departing from the spirit or scope of the following claims.

What is claimed is:

1. In combination, an associated structure disposed at a body of water, and a submergible water activity assembly carried by said associated structure, wherein the combination comprises:

a submergible activity platform disposed below an upper surface of said associated structure for being submerged in the body of water;

a support structure mounting said submergible activity platform to said associated structure;

an adjusting mechanism included in said support structure for vertically moving said submergible activity platform to adjust the distance between said submergible activity platform and said upper surface of said associate structure;

said adjusting mechanism includes a guide member affixed to said associated structure and a vertical frame leg carried by said submerged activity platform; said guide member and said vertical frame leg being connected together for relative vertical movement so that the vertical position of the platform can be adjusted; and, a walkway extending from said associated structure to said submergible activity platform for providing access between said upper surface of said associated structure and said submergible activity platform.

2. The combination of claim 1 wherein said guide member includes an adjusting element for selling said vertical frame leg at a selected location along said guide member; said adjusting element being received by a complementary receiving element of said vertical frame leg to hold said submergible activity platform at a set position.

3. The combination of claim 1 wherein said walkway includes a floating ramp having a first end pivotally carried by said guide member and a second end freely resting on said submergible activity platform so that said walkway maintains contact with said submergible activity platform as said platform is moved vertically.

4. The combination of claim 1 wherein said support structure includes a brace arm extending rearwardly from said support structure across a portion of said upper surface of said associated structure and being affixed thereto to stabilize said submergible activity platform.

5. The combination of claim 1 wherein said support structure includes a retaining bracket carried by said support structure having a vertical leg engaging a bottom edge portion of said associated structure to restrict movement of said submergible activity platform.

6. The combination of claim 1 wherein said submergible activity platform includes a plurality of elongated decking members; a plurality of water flow passages are defined by narrow openings formed between adjacent decking members which allow water to flow through said submergible activity platform.

7. The combination of claim 1 wherein said walkway includes a ramp having a first end carried by said support structure and a second end resting on said submergible activity platform; said ramp including a rail disposed along the length of said ramp for supporting persons moving on said ramp.

8. The combination of claim 1 wherein said submergible activity platform includes a landing section disposed at a base of said walkway adjacent said water activity section allowing a person to walk onto said submergible activity platform from said walkway and enter a water activity section of said submergible activity platform.

9. The combination of claim 1 including a flotation member carried by said submergible activity platform providing buoyancy to offset a portion of the weight of said water activity assembly when in the water.

10. A water activity assembly for use with an associated structure on a body of water to provide access from said associated structure to the water, said assembly comprising:

an activity platform for being submerged in the water to support persons engaged in water activities;

a support structure for mounting said activity platform to said associated structure;

an adjusting mechanism included in said support structure having a guide member for being affixed to said associated structure and a vertical frame leg carried by said activity platform; said guide member and said vertical frame leg being connected together for relative vertical movement so that the vertical position of said activity platform can be adjusted to raise and lower the activity platform; and, a walkway carried at least in part by said activity platform for providing access between said associated structure and said activity platform when said activity platform is submerged.

11. The assembly of claim 10 wherein said support structure includes a brace arm extending rearwardly from said support structure for being affixed to an upper surface of said associated structure to stabilize said activity platform when submerged in the water.

12. The assembly of claim 10 wherein said support structure includes a first side frame carried on a first side of said activity platform, and a second side frame carried on a second side of said activity platform; said first and second side frames supporting said activity platform when mounted to said associated structure.

13. The assembly of claim 12 wherein said first and second side frames include said adjusting mechanism for vertically moving said activity platform.

14. The assembly of claim 10 wherein said guide member includes an adjusting element for setting said vertical frame leg at a selected location along said guide member; said adjusting element being received by a complementary receiving element of said vertical frame leg for holding said activity platform at a set position.

15. The assembly of claim 10 wherein said support structure includes a retaining bracket carried by said support structure having a vertical leg for engaging a bottom edge portion of said associated structure to restrict movement of said activity platform when mounted to said associated structure.

16. The assembly of claim 10 wherein said activity platform includes a plurality of elongated decking members; a plurality of water flow passages are defined by narrow openings formed between adjacent decking members which allow water to flow through said activity platform.

17. The assembly of claim 10 wherein said walkway includes a ramp having a first end carried by said support structure and a second end resting on said activity platform; said ramp including a rail disposed along the length of said ramp for supporting persons moving on said ramp.

18. The assembly of claim 10, wherein said activity platform includes a landing section disposed at a base of said walkway adjacent said water activity section for allowing a person to walk onto said activity platform from said walkway and enter a water activity section of said activity platform.

19. The assembly of claim 10 including a flotation member carried by said activity platform for providing buoyancy to offset a portion of the weight of said water activity assembly in the water when mounted to said associated structure.

* * * * *